US006101644A

United States Patent [19]

Gagneur et al.

[11] Patent Number: 6,101,644

[45] Date of Patent: Aug. 15, 2000

[54] TRANSPORT CART/PATIENT TABLE SYSTEM FOR EXCHANGING AN EXCHANGEABLE SLAB, AND TRANSPORT CART FOR THIS SYSTEM

[75] Inventors: Klaus Gagneur, Baiersdorf; Herbert Weiler, Alling, both of Germany

[73] Assignee: Siemens Aktiengesellschaft, Munich, Germany

[21] Appl. No.: 09/123,188

[22] Filed: Jul. 27, 1998

[30] Foreign Application Priority Data

Jul. 28, 1997 [DE] Germany ..... 197 32 467

[51] Int. Cl.[7] ..... A61G 7/08; A61G 7/10; A47B 9/00

[52] U.S. Cl. ..... 5/81.1 R; 5/86.1; 5/81.1 HS; 108/147

[58] Field of Search ..... 5/81.1 R, 86.1, 5/81.1 C, 81.1 HS; 108/147

[56] References Cited

U.S. PATENT DOCUMENTS

| | | | |
|---|---|---|---|
| 3,820,176 | 6/1974 | Feiertag | 108/147 X |
| 4,222,132 | 9/1980 | Crim et al. | 5/81.1 R |
| 5,014,968 | 5/1991 | Lammers et al. | 5/611 |
| 5,123,797 | 6/1992 | Schnelle et al. . | |
| 5,257,425 | 11/1993 | Shinabarger | 5/86.1 X |
| 5,829,766 | 11/1998 | Gohlert | 5/81.1 R X |
| 5,896,602 | 4/1999 | Marblestone | 5/81.1 R |
| 6,006,376 | 12/1999 | Williamson | 5/81.1 R |

FOREIGN PATENT DOCUMENTS

| | | |
|---|---|---|
| 0 625 348 | 11/1994 | European Pat. Off. . |
| 30 34 932 | 4/1982 | Germany . |
| 88 15 279 U | 3/1989 | Germany . |
| 296 10 726 U | 10/1996 | Germany . |

*Primary Examiner*—Terry Lee Melius
*Assistant Examiner*—Rodrigo J. Morales
*Attorney, Agent, or Firm*—Hill & Simpson

[57] ABSTRACT

Transport cart/patient table system for transferring an exchangeable slab of the patient table, which slab can be moved by means of a lifting arrangement, between the table and the transport cart, whereby the transport cart is moved under the patient table for the transfer of the exchangeable slab, has a first guide arranged on the transport cart and a second guide arranged on the patient table, which can be brought to engage one another as the cart is moved under the table. The guides engage in such a way to allow the transport cart to be pivotable and to be displaced longitudinally, while the engaged guides serve to guide the transport cart.

28 Claims, 3 Drawing Sheets

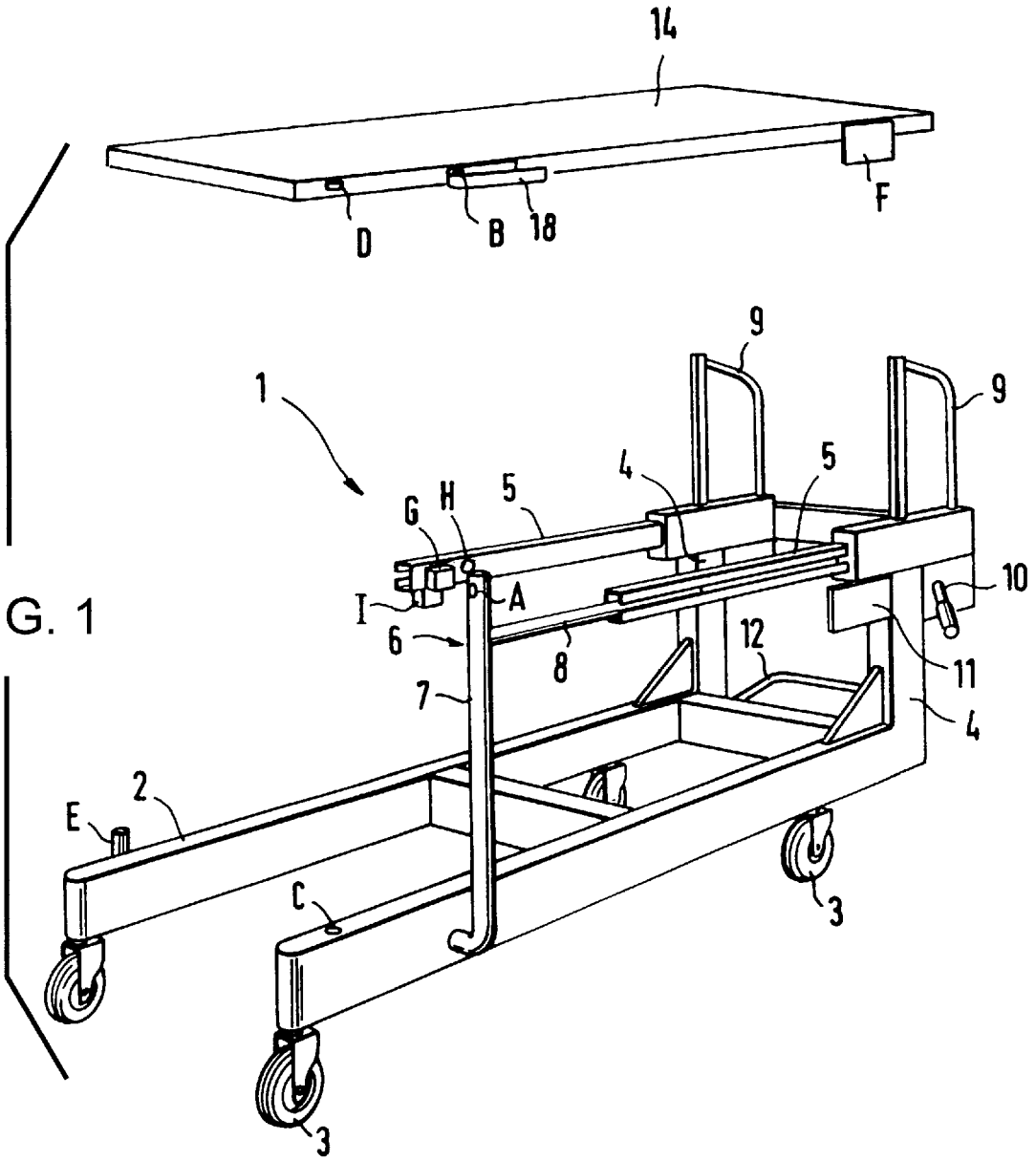
FIG. 1
FIG.1A
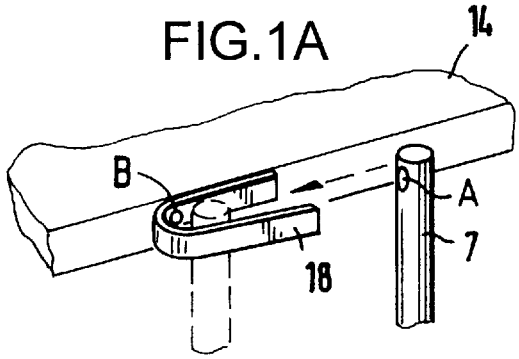

TRANSPORT CART/PATIENT TABLE SYSTEM FOR EXCHANGING AN EXCHANGEABLE SLAB, AND TRANSPORT CART FOR THIS SYSTEM

BACKGROUND OF THE INVENTION

1. Field of the Invention

The present invention relates to a transport cart/patient table system for exchanging slab of the patient table that can be transferred by a lifting arrangement between this the patient and the transport cart, the transport cart being movable beneath the patient table for the transferring the exchangeable slab.

2. Description of the Prior Art

Systems of this sort are used, for example, in medical therapy and diagnosis apparatuses, such as a magnetic resonance apparatus. By means of this system, it is possible to exchange an exchangeable slab, on which the patient is to be received or from which the patient is to be removed, from the patient table to the transport cart, and vice versa. For this purpose, the transport cart is moved under the patient table, the actual exchanging then taking place by operating the lifting arrangement of the patient table, which correspondingly raises or lowers the exchangeable slab. In known systems of this sort, the transport cart can be moved underneath the patient table only from one side of the table, and for this purpose the transport cart already must be oriented precisely relative to the patient table before being moved beneath it, since the transport cart is guided at the corresponding sides by suitable guide means on the patient table. The necessity of moving the transport cart to the table from one side only is inconvenient in several respects. Approach from this one side is compulsory, that is, no alternative approach possibilities exist. Also, this one-side parallel approach is possible only given corresponding space, that is, the entire system can be used only in correspondingly large rooms. If these conditions are not present in a particular room, it is not possible with the known system to move the patient directly into that treatment room by means of the transport cart.

A transport cart/patient table system of the type described above, which enables an approach of the transport cart only transversely to the longitudinal direction of the patient table, is known, for example, from German OS 30 34 932.

In German OS 39 24 390, a transport cart for operating table slabs is described which is guided under an operating table by means of guide elements in the longitudinal direction. Rollers that can be moved in the axial direction enable a certain transverse motion of the transport cart relative to the direction of propulsion.

Further transport carts for operation table slabs are known from German utility models 296 10 726 and 88 15 279. Guide means for these known carts are fashioned in such a way that the transport cart can be moved underneath an operating table from two opposed sides.

European Application 0 625 348 discloses two different systems for transport carts, namely one for transverse advance and one for longitudinal advance of the operating table slab. The correct position of the operating table slab is acquired by means of infrared sensors.

SUMMARY OF THE INVENTION

An object of the present invention is to improve a system of the type described above in such a way that an approach of the transport cart to the patient table from different directions is possible.

This object is inventively achieved in a system of the general type initially described wherein first guide means are arranged on the transport cart and second guide means are arranged on the patient table, which engage the first guide means when the transport cart is moved underneath the patient table, and cause the transport cart to be guided in pivotable and longitudinally displaceable fashion.

In the inventive system, two guide means are used that cannot be brought into rigid engagement with one another, but rather when engaged enable pivoting and displacement of the transport cart. That is, in the inventive system, due to the use of the inventive guide means, the limited rigid approach direction applicable to conventional systems is eliminated, and an arbitrary approach is enabled, because the transport cart continues to be pivotable and displaceable during engagement, and thus can be unproblematically pivoted beneath the table and simultaneously still displaced longitudinally. It is particularly an advantage to be able to move the transport cart to the patient table at an arbitrary angle, as long as an engagement of the guide means is thereby achieved. According to the invention, the guide means can be fashioned as a rod, or a peg, or as a groove, a rail, a fork or the like. In the selection of the respective first and second guide means it makes no difference whether the first guide means is fashioned for example as a rod and the second guide means as a fork, or vice versa, since both modifications lead equally to success according to the invention.

It has proven useful for at least the first guide means, but preferably both guide means, to be detachable, and preferably one or both guide means is/are attachable to the respective sides of the transport cart, or of the patient table, respectively. This inventive construction makes it possible for the operating personnel to react flexibly to various space conditions; i.e., it is possible to arrange the respective guide means on the corresponding side, e.g. when an approach to the patient table from the right is required. If an approach from the left is required at another patient table in another room, it is unproblematically possible to fasten the first guide means to the other side of the cart. Since the precise positioning of the transport cart underneath the patient table in such exchange systems is of particular importance, in a further embodiment of the invention, at least one stop, limiting in particular a rotational motion of the transport cart, is provided on the transport cart and/or on the patient table. In order to allow the possibility of exchanging the respective guide means it is of course possible to provide several such stops, in order to enable limitation of a rotational motion from the left and also from the right, as well as the longitudinal displacement.

The actual exchange procedure for exchanging the slab from the patient table to the transport cart takes place with the transport cart being positioned underneath the patient table, after which the table is lowered by means of its lifting arrangement until the exchangeable slab lies on the transport cart. Subsequently, the lifting arrangement is further lowered in order to completely release the exchangeable slab. In order to be able to pivot the transport cart out of its position under the patient table even in this lowered state of the patient table, the transport cart in accordance with the invention can have a generally C-shaped construction, formed from a chassis frame, vertical braces arranged on the end thereof, and support arms arranged thereon, which support the exchangeable slab. Due to the inventive C-shaped construction, it is possible to pivot away the transport cart easily even when the patient table is lowered, i.e., when the support frame bearing the exchangeable slab is lowered for the release of the exchangeable slab, with the chassis frame and the support arms, together with the exchangeable slab, then being pivoted. This inventive embodiment also considerably improves convenience of use. In order to increase positioning security, in addition, in the region of the first and the second guide means, at least one sensor means is provided for identifying when engagement has occurred, in particular it can sense the final engagement position. In addition, at least one further sensor means can be provided for determining the positioning of the transport cart relative to the patient table, so that both the correct longitudinal positioning and the correct lateral positioning are acquired with certainty.

In order to fasten the exchangeable slab securely to the transport cart, in a further inventive embodiment a locking arrangement is provided on the transport cart for fixing the exchangeable slab thereon. This is particularly useful when, given a C-shaped construction of the transport cart, the support arms are somewhat shortened in relation to the chassis frame, i.e., in this case the exchangeable slab is not supported along its entire length. Given locking of the exchangeable slab, in this way it is also possible to realize a secure transport with this construction, i.e., it is advantageously prevented that a patient on the slab can tip over together with the exchangeable slab, given a shifting of weight. In order to further increase security in this regard, according to the invention at least one additional sensor, working together with the locking element, is provided for sensing the state of the locking arrangement. The same purpose can be served by another arresting arrangement, in particular a mechanical arrangement, in the receiving area of the exchangeable slab on the transport cart, in particular on the support arms, which is provided for automatically arresting the locking arrangement, and is automatically actuated when the exchangeable slab is received, so that unintentional detachment (unlocking) of the locking arrangement is likewise avoided.

It has proven particularly useful to provide at least one sensor that has a field of view between the patient table and the transport cart, for determining the position of the exchangeable slab relative to the transport cart. One or all of the aforementioned sensors can be connected to corresponding acoustic or optical signal emitters, which emit a signal given corresponding errors, dependent on the sensor outputs. It has also proven particularly advantageous for the control of the lifting arrangement of the patient table to take place dependent on the determination result (output) of at least one of the sensors, so that for example if the exchangeable slab position is not precise, the lifting arrangement is blocked automatically. All known types of sensors can be used as the aforementioned sensors, e.g. photosensor assemblies, magnetic sensors or the like, or an infrared sensor and a reflector element allocated thereto. In order to improve further the precise positioning of the transport cart relative to the patient table, within the scope of the invention an additional guide element or centering element, such as a guide plate, can be provided on the transport cart and/or on the patient table.

Besides the overall system, the invention also relates to a transport cart for use in this system. In accordance with the invention, this transport cart has a generally C-shaped construction, formed from a chassis frame, with vertical braces arranged at the end side thereof, and support arms, which receive the exchangeable slab, arranged on these braces.

DESCRIPTION OF THE DRAWINGS

FIG. 1 shows a perspective view of an inventive transport cart, used in the system according to the invention.

FIG. 1A shows an enlarged detail from FIG. 1, illustrating an embodiment of the guide elements.

DESCRIPTION OF THE PREFERRED EMBODIMENTS

Figure 2:
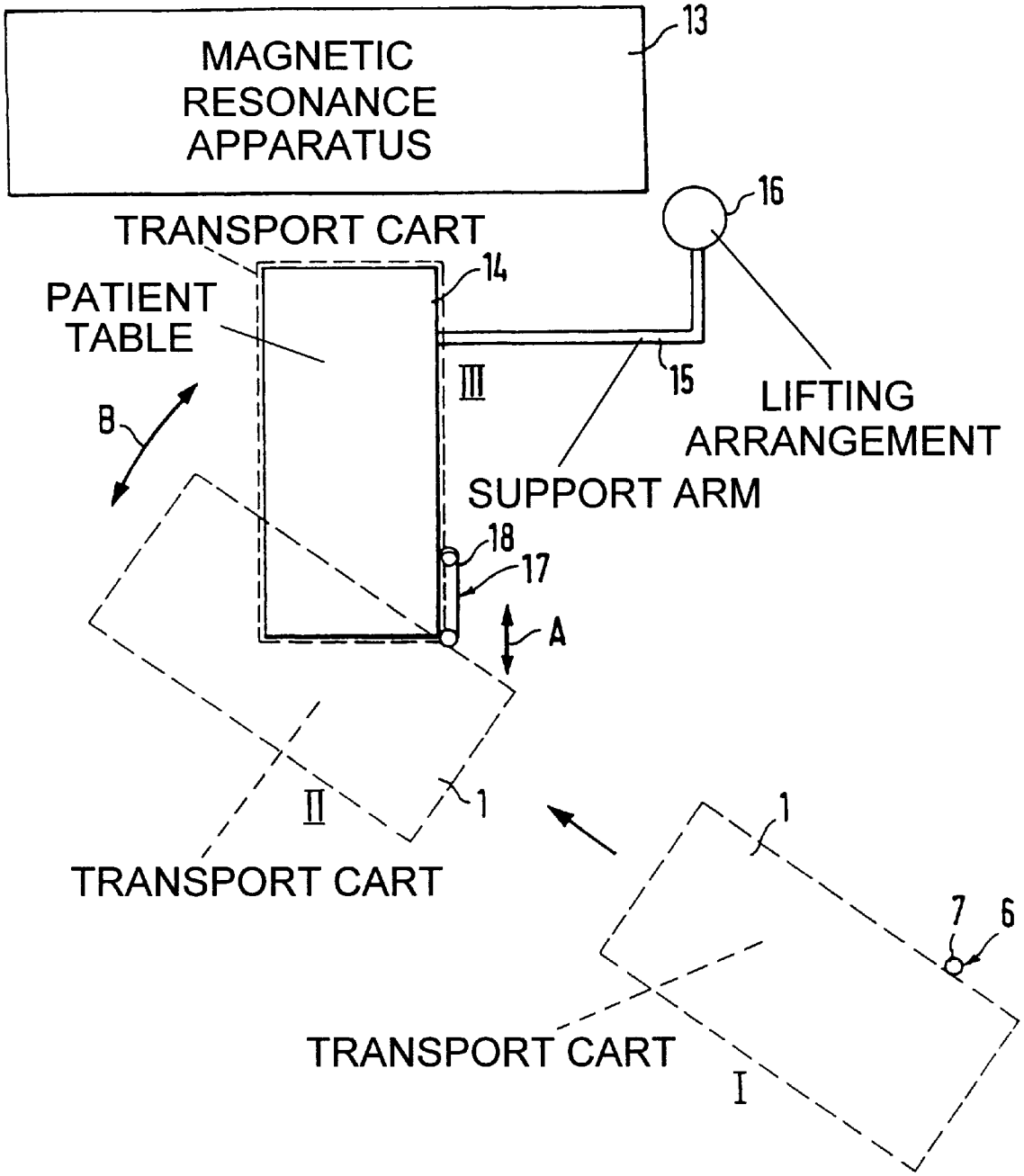
FIG. 2 schematically illustrates a procedure including approach, moving under, and positioning of the transport cart relative to the patient table in the system according to the invention.

FIG. 1 shows an inventive transport cart 1, having a generally shaped construction. The cart 1 has a chassis frame 2 with integrated cams arranged thereunder, which are preferably nonmagnetic, which interact with rollers 3 thereby forming a central arresting mechanism. At the rear end of the chassis frame 2, two vertical braces 4 are arranged, and two support arms 5 are in turn fastened to the upper ends thereof. The exchangeable slab 14A of the patient table (see FIG. 2) is received on these support arms 5 upon transfer to the cart 1. As shown in FIG. 1, a first guide 6 in the form of a rod 7 is fastened to a support arm 5, which is arranged with one end on the chassis frame 2 and with its other end engaging the support arm 5 by means of a cantilever beam 8. This rod 7 serves for engagement in a second guide on the slab 14A, preferably formed as a fork 18, as shown in detail in FIG. 1A. The guide 6 is thereby detachably fastened to the chassis frame 2, i.e., it can be fastened to the chassis frame 2 at the other side of the transport cart 1 as well. Instead of this construction, the guide 6 can be fashioned as a short peg or the like that projects upwardly and is for example fastened to a support arm. Other modifications and arrangements are also conceivable, as long as these enable a sufficiently secure engagement, enabling the inventive movability, with the second guide on the slab 14A.

As FIG. 1 also shows, sliding handles 9 are attached in the region of the vertical braces 4. In this region, a handle 10 of a locking arrangement G is also located for locking the received exchangeable slab or for detaching it for the purpose of lifting it off. A sensor H indicates when locking has occurred. In addition, further centering is obtained by means of a guide plate 11, which likewise serves for the secure centering and positioning of the transport cart 1 relative to the slab 14A. The actuator 12 for a braking arrangement is also visible, by means of which the transport cart 1 can be arrested in its current position.

In the form of a schematic drawing, FIG. 2 shows the sequence of motion during the approach, moving under and positioning procedures in the inventive system. As an example, the transport cart 1, shown in broken lines, is essentially moved from the right in the treatment room in which the medical examination apparatus is arranged, for example in the form of a magnetic resonance apparatus 13, together with a patient table 14. The patient table 14 on which the slab 14A is supported in a known manner, is connected to a lifting arrangement 16 via a corresponding support arm 15, so that it can be brought into various operating positions in a known way. For moving the cart 1 under it, patient table 14 is in a raised position. At the slab 14A, in the example shown a second guide 17 is on the right longitudinal side in the form of a fork 18 that is open toward the front and also open upwardly if warranted. The transport cart 1 (position I), on whose right side the first guide 6 is arranged in the form of the rod 7, is now caused to approach the patient table 14 so that the rod 7 can be introduced into the fork 18, as shown in position II. In this position 11, in which the guide rod 7 is already somewhat contained in the fork 18, the transport cart 1 is both longitudinally movable, as shown by the double arrow 19, and also is pivotable, as shown by the double arrow 20. That is, with the inventive guides 6 and 17, it is possible to move the transport cart 1 to the slab 14A on the patient table 14 from any direction, as long as it is ensured that the two guides 6 and 17 engage one another. In order to position the transport cart 1 precisely relative to the slab 14A, it is pushed further under the patient table 14 and is simultaneously pivoted in until it has reached position III. The correct positioning is acquired by components of a sensor, on the rod 7 and the fork 18, for example, an infrared transmitter/receiver A and a reflector B, which acquire at least the precise final position as indicated by the dashed lines in FIG. 1A, and as shown from above in FIG. 2. Likewise, additional sensors C and D are arranged e.g. on the edge of the slab 14A and on the transport cart 1, these sensors communicating with one another, so that the precise positioning can be acquired. In addition, corresponding stops, such as stop E, are preferably provided on the transport cart 1, which limit the insertion and pivoting motion. After termination of the positioning, the patient table 14 can be lowered, so that the exchangeable slab 14A is received on the support arms 5. After further lowering (which preferably takes place only when the respective sensors indicate the correct positioning of the exchangeable slab 14A, the locking of the slab 14A, etc.), the support frame of the patient table 14 is detached from the exchangeable slab 14A, causing the slab 14A to be released. Due to the C-shaped construction of the transport cart 1, it is possible to arbitrarily remove this cart 1, after it has received the slab 14A, from the patient table 14, i.e., it can already be pivoted somewhat, or the like, before being withdrawn, since, just as in moving the cart 1 under the patient table 14, during withdrawal the inventive guides 6 and 17 also cause no limitation of motion or direction, except that the guides 6 and 17 must be detached from one another.

Figure 3:
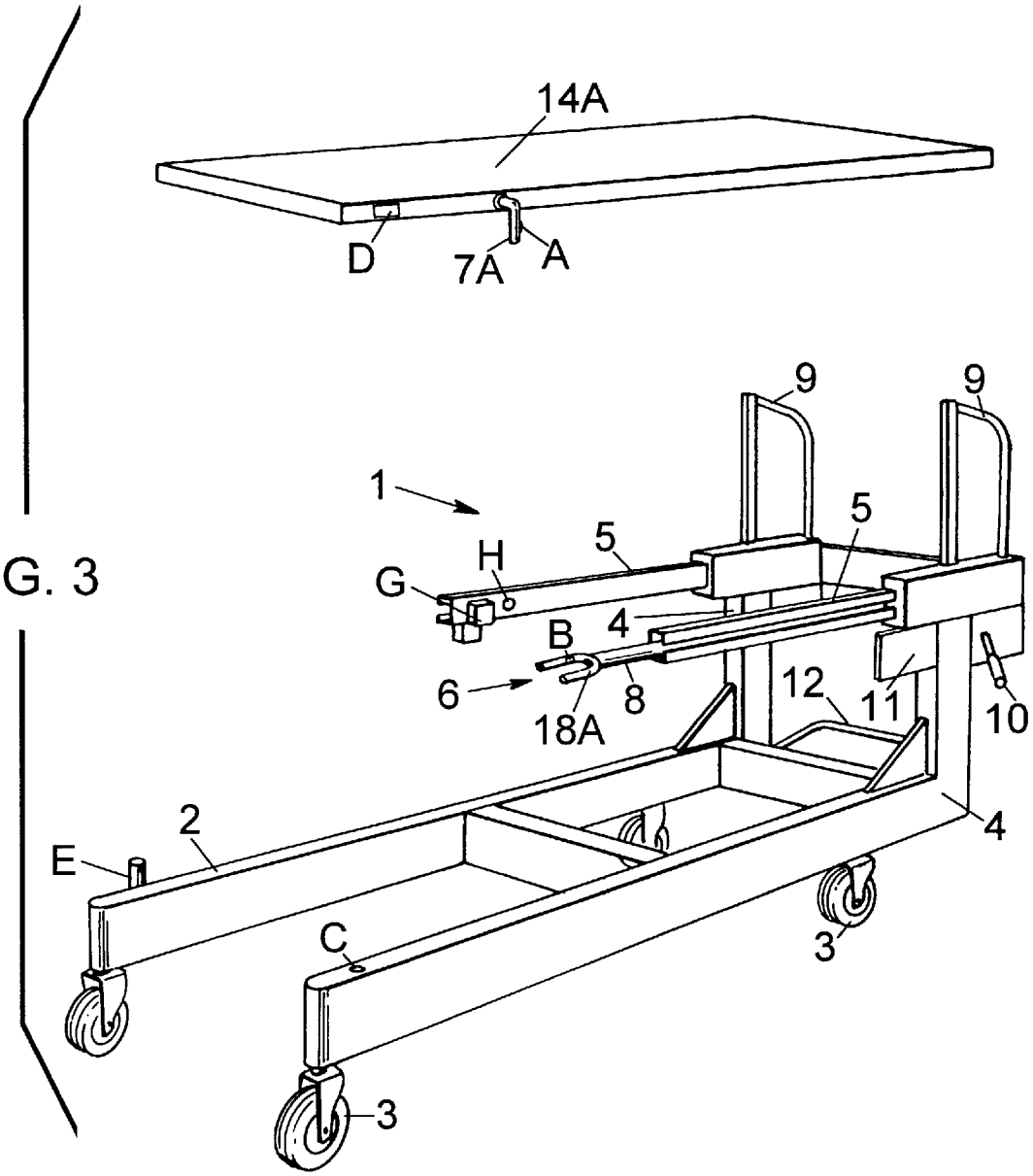
FIG. 3 shows a perspective view of a further embodiment of an inventive transport cart, used in the system according to the invention.
Figure 3A:
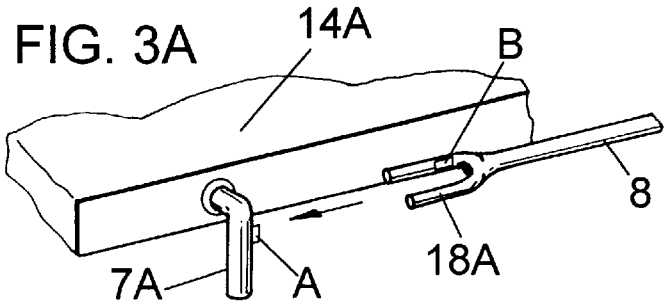
FIG. 3A shows an enlarged detail from FIG. 3, illustrating a further embodiment of the guide elements.

FIGS. 3 and 3A show an alternative embodiment of the guide elements, which is opposite to that of the embodiment shown in FIGS. 1 and 1A. In the embodiment of FIGS. 3 and 3A, the guide element 6 is a fork 18A, and this is carried on the cantilever beam 8 of the cart 1. This element engages a rod 7A carried on the slab 14A. Sensing of the final position takes place using the sensors A and B in the same manner as described above.

Although modifications and changes may be suggested by those skilled in the art, it is the intention of the inventors to embody within the patent warranted hereon all changes and modifications as reasonably and properly come within the scope of their contribution to the art.

What is claimed is:

1. A system for exchanging a patient slab of a patient support table, said system comprising:

said patient support table and said patient slab;

means at said patient support table for vertically moving said slab;

a transport cart movable beneath said patient support table for allowing transfer of said slab between said transport cart and said patient table;

a first guide mounted on said transport cart;

a second guide mounted on said patient table which is temporarily engageable with said first guide; and said first and second guides, when engaged, forming means for guiding said transport cart beneath said patient table while allowing pivoting and longitudinal displacement of said transport cart.

2. A system as claimed in claim 1 wherein said first guide comprises a rod-like element, and wherein said second guide comprises a receptacle for said rod-like element.

3. A system as claimed in claim 1 wherein said second guide comprises a rod-like element, and wherein said first guide comprises a receptacle for said rod-like element.

4. A system as claimed in claim 1 wherein said transport cart has longitudinal sides and said first guide is detachable from said transport cart and is selectively attachable to either one of said longitudinal sides of said transport cart.

5. A system as claimed in claim 1 wherein said transport cart has longitudinal sides and said second guide is detachable from said patient table and is selectively attachable to either one of said longitudinal sides of said transport cart.

6. A system as claimed in claim 1 wherein said first guide is detachable from said transport cart and wherein said second guide is detachable from said patient table.

7. A system as claimed in claim 1 further comprising at least one stop element, disposed on at least one of said transport cart and said patient table, for limiting rotational motion of said transport cart when said first guide and said second guide are engaged.

8. A system as claimed in claim 1 wherein said transport cart is generally C-shaped, and comprises a chassis frame, two vertical braces disposed at an end of said chassis frame, and two support arms respectively mounted on said two vertical braces, said support arms receiving said slab when said first and second guides are engaged, and thereafter supporting said slab.

9. A system as claimed in claim 1 further comprising sensor means for identifying engagement of said first guide and said second guide.

10. A system as claimed in claim 9 wherein said first guide and said second guide have a final engaged position, and wherein said sensor means comprises means for identifying when said first guide and said second guide are in said final engaged position.

11. A system as claimed in claim 9 wherein said lifting means is controlled dependent on an output signal of said sensor means.

12. A system as claimed in claim 9 wherein said sensor means comprises an infrared transmitter/receiver, which emits and receives infrared radiation, mounted on one of said transport cart and patient table, and an infrared reflector, which reflects said infrared radiation emitted by said infrared transmitter/receiver back toward said infrared transmitter/receiver mounted on the other of said transport cart and patient table.

13. A system as claimed in claim 1 further comprising sensor means for identifying a position of said transport cart relative to said patient table.

14. A system as claimed in claim 13 wherein said lifting means is controlled dependent on an output signal of said sensor means.

15. A system as claimed in claim 13 wherein said sensor means comprises an infrared transmitter/receiver, which emits and receives infrared radiation, mounted on one of said transport cart and patient table, and an infrared reflector, which reflects said infrared radiation emitted by said infrared transmitter/receiver back toward said infrared transmitter/receiver mounted on the other of said transport cart and patient table.

16. A system as claimed in claim 1 further comprising locking means for locking said exchangeable slab to said transport cart.

17. A system as claimed in claim 16 wherein said locking means has a locked state and an unlocked state, and further comprising sensor means.

18. A system as claimed in claim 17 wherein said lifting means is controlled dependent on an output signal of said sensor means.

19. A system as claimed in claim 17 wherein said sensor means comprises an infrared transmitter/receiver, which emits and receives infrared radiation, mounted on one of said transport cart and patient table, and an infrared reflector, which reflects said infrared radiation emitted by said infrared transmitter/receiver back toward said infrared transmitter/receiver mounted on the other of said transport cart and patient table.

20. A system as claimed in claim 16 wherein said lifting means is controlled dependent on an output signal of said sensor means.

21. A system as claimed in claim 16 wherein said sensor means comprises an infrared transmitter/receiver, which emits and receives infrared radiation, mounted on one of said transport cart and patient table, and an infrared reflector, which reflects said infrared radiation emitted by said infrared transmitter/receiver back toward said infrared transmitter/receiver mounted on the other of said transport cart and patient table.

22. A system as claimed in claim 1 further comprising sensor means for identifying a position of said exchangeable slab relative to said transport cart.

23. A system as claimed in claim 22 wherein said lifting means is controlled dependent on an output signal of said sensor means.

24. A system as claimed in claim 22 wherein said sensor means comprises an infrared transmitter/receiver, which emits and receives infrared radiation, mounted on one of said transport cart and patient table, and an infrared reflector, which reflects said infrared radiation emitted by said infrared transmitter/receiver back toward said infrared transmitter/receiver mounted on the other of said transport cart and patient table.

25. A system as claimed in claim 1 further comprising at least one additional guide mounted on said transport cart for guiding said transport cart relative to said patient table.

26. A system as claimed in claim 25 wherein said at least one additional guide is detachably mounted to said transport cart.

27. A system as claimed in claim 1 further comprising at least one additional guide mounted to said patient table for guiding said transport cart relative to said patient table.

28. A system as claimed in claim 27 wherein said at least one additional guide is detachably mounted to said patient table.

* * * * *